US009556560B2

(12) United States Patent
Boeck

(10) Patent No.: US 9,556,560 B2
(45) Date of Patent: Jan. 31, 2017

(54) FORMING FABRIC

(71) Applicant: VOITH PATENT GMBH, Heidenheim (DE)

(72) Inventor: Johann Boeck, Fornach (AT)

(73) Assignee: Voith Patent GmbH, Heidenheim (DE)

( * ) Notice: Subject to any disclaimer, the term of this patent is extended or adjusted under 35 U.S.C. 154(b) by 139 days.

(21) Appl. No.: 14/522,634

(22) Filed: Oct. 24, 2014

(65) Prior Publication Data

US 2015/0090417 A1 Apr. 2, 2015

Related U.S. Application Data

(63) Continuation of application No. PCT/EP2013/058597, filed on Apr. 25, 2013.

(30) Foreign Application Priority Data

Apr. 27, 2012 (DE) ..... 10 2012 207 044

(51) Int. Cl.
*D21F 1/10* (2006.01)
*D03D 13/00* (2006.01)
(Continued)

(52) U.S. Cl.
CPC ..... *D21F 1/0045* (2013.01); *D03D 13/004* (2013.01); *D03D 3/04* (2013.01); *D03D 11/00* (2013.01)

(58) Field of Classification Search
CPC .... D21F 1/0027; D21F 1/0036; D21F 1/0045; D21F 1/0054; D21F 1/10; D21F 1/12;D21F 1/105; D21F 7/08; D21F 7/10; D21F 7/12; D21F 7/083; D03D 3/04; D03D 11/00; D03D 13/00; D03D 13/004; D03D 13/008
(Continued)

(56) References Cited

U.S. PATENT DOCUMENTS 7,048,830 B2 * 5/2006 Heger ..... D21F 1/0045 139/383 A
8,652,302 B2 2/2014 Boeck et al.
(Continued)

FOREIGN PATENT DOCUMENTS

DE 102007058369 A1 6/2009

*Primary Examiner* — Eric Hug
(74) *Attorney, Agent, or Firm* — Laurence A. Greenberg; Werner H. Stemer; Ralph E. Locher

(57) ABSTRACT

A woven-fabric web, such as a forming fabric or forming wire, for a machine for producing and/or processing a fibrous web, has a first woven-fabric layer with first longitudinal threads and first transverse threads interwoven with the first longitudinal threads and a second woven-fabric layer with second longitudinal threads and second transverse threads interwoven with the second longitudinal threads. The weaving pattern of the fabric is repeated in pattern repeats. The first and second longitudinal threads are arranged in a plurality of groups in each pattern repeat, with a first group and a second group and at least one further of the first and/or second group. Each first group is formed from a first longitudinal thread and a second longitudinal thread arranged below the first longitudinal thread and the first and second longitudinal threads in each group are arranged at no offset or only a slight offset in plan view.

20 Claims, 7 Drawing Sheets

(51) Int. Cl.
*D21F 1/00* (2006.01)
*D03D 11/00* (2006.01)
*D03D 3/04* (2006.01)

(58) Field of Classification Search
USPC ..... 162/348, 358.2, 900–904; 139/383 A, 139/383 AA, 425 A
See application file for complete search history.

(56) References Cited

U.S. PATENT DOCUMENTS

2006/0243339 A1* 11/2006 Hay ..... D21F 1/0045 139/421
2009/0283233 A1* 11/2009 Boeck ..... D21F 1/0036 162/202

* cited by examiner

FORMING FABRIC

CROSS-REFERENCE TO RELATED APPLICATION

This application is a continuation, under 35 U.S.C. §120, of copending international application No. PCT/EP2013/058597, filed Apr. 25, 2013, which designated the United States; this application also claims the priority, under 35 U.S.C. §119, of German patent application No. 10 2012 207 044.3, filed Apr. 27, 2012; the prior applications are herewith incorporated by reference in their entirety.

BACKGROUND OF THE INVENTION

Field of the Invention

The invention relates to a fabric tape or fabric web, in particular a forming wire, for a machine for manufacturing and/or processing a fibrous web, in particular a paper web, cardboard web or tissue web.

Modern fabric tapes which are employed as a forming wire in a forming section of a paper-, cardboard- or tissue-making machine typically have a first fabric layer which provides a paper side which can be brought into contact with the paper web, and a second fabric layer which provides a machine side which can be brought into contact with elements of the machine. Different requirements are set here for the first and the second fabric layers, specifically in terms of the first fabric layer providing as good a fiber support as possible when forming and dewatering the fibrous web and of the second fabric layer essentially providing the wear volume and the dimensional stability of the fabric tape.

Fabric tapes which are configured as forming wires in which the ratio of the number of longitudinal threads of the first fabric layer to the number of longitudinal threads of the second fabric layer is 1:1 are known from the prior art. Such forming wires have the disadvantage that the use of comparatively thick longitudinal threads of the second fabric layer, for providing an adequately high dimensional stability of the wire, leads to a rather open upper fabric layer having only slight fiber support. In order to overcome the disadvantages of such wires, in the past wires having a ratio of the number of longitudinal threads of the first fabric layer to the number of longitudinal threads of the second fabric layer of more than one have been proposed, such as 2:1, 3:2 or 5:2 for example. On account thereof, it became possible to achieve both satisfactory fiber support by way of the first fabric layer and also satisfactory dimensional stability by way of the second fabric layer. It has proven disadvantageous in the aforementioned wires that often an increased tendency toward visible hydraulic markings of the fibrous web produced thereon exists, as does insufficient planarity of the first fabric layer, since the longitudinal threads of the first fabric layer (first longitudinal threads) are only insufficiently supported by the longitudinal threads of the second fabric layer (second longitudinal threads). Insufficient planarity may lead to an undesirable accumulation of fibers and filler material in the "depressions" of the first fabric layer.

In the case of the forming wires known from the prior art, these disadvantages are observed as the ratio of the number of upper longitudinal threads to the number of lower longitudinal threads increases.

SUMMARY OF THE INVENTION

It is accordingly an object of the invention to provide a forming wire which overcomes the disadvantages of the heretofore-known devices of this general type and which provides for a fabric tape for use as a forming wire in a machine for manufacturing and/or processing a fibrous web, such as in particular a paper web, cardboard web or tissue web, which, on the one hand, provides high fiber support for a fibrous web to be formed and dewatered thereon, in conjunction with good dimensional stability, and which, on the other hand, has only few hydraulic markings and also improved planarity of the first fabric layer, in contrast to the wires known from the prior art.

With the above and other objects in view there is provided, in accordance with the invention, a fabric tape for a machine for manufacturing and/or processing a fibrous web, the fabric tape comprising:

a first fabric layer having first longitudinal threads and first cross threads interwoven with said first longitudinal threads;

a second fabric layer having second longitudinal threads and second cross threads interwoven with said second longitudinal threads;

said first and second fabric layers being disposed on top of one another and having a weaving pattern repeated in repeats;

said first longitudinal threads and said second longitudinal threads in each repeat being disposed in a plurality of groups, having one first group and one second group and at least one further of said first and/or second group;

each said first group being formed by one first longitudinal thread and one second longitudinal thread disposed below said one first longitudinal thread;

each second group being formed by two first longitudinal threads and one second longitudinal thread disposed below said two first longitudinal threads;

said first and second longitudinal threads in each group, viewed in a projection perpendicularly onto said fabric layers, being disposed so as not to be offset or only slightly offset in relation to one another, so as to form at maximum a free space of half a diameter of a first longitudinal thread therebetween.

In other words, the objects of the invention are achieved by a fabric tape, in particular a forming wire, for a machine for manufacturing and/or processing a fibrous web, that comprises a first fabric layer having first longitudinal threads and, interwoven therewith, first cross threads, and a second fabric layer having second longitudinal threads and, interwoven therewith, second cross threads, in which the two fabric layers are disposed on top of one another and the weaving pattern of the fabric tape is repeated in repeats and the first longitudinal threads and the second longitudinal threads in each repeat are disposed in a plurality of groups. The fabric tape according to the invention here comprises in each repeat one first group and one second group and at least one further group selected from the first and/or second group, wherein each first group is formed by one first longitudinal thread and, disposed therebelow, one second longitudinal thread, and each second group is formed in each case by two first longitudinal threads and, disposed therebelow, one second longitudinal thread, and wherein the first and second longitudinal threads belong to a respective group, when viewed in a projection which is perpendicular onto the fabric layers, are disposed so as not to be offset or only slightly offset in relation to one another, such that at maximum a free space of half a diameter of a first longitudinal thread is formed between them.

For exemplification, FIGS. 4 and 5, in a sectional plane which runs along the cross-thread direction CD and perpendicularly to the fabric layers and/or to the planes PS, MS defined thereby, show a second group 6 and a first group 5 of longitudinal threads 3, 4. It can be seen that the first and second longitudinal threads 3, 4 are disposed on top of one another in such a manner that said threads, when viewed in a projection which is perpendicular onto the fabric layers and/or onto the planes PS, MS defined thereby—identified by the lines A-A—are disposed just that slightly offset in relation to one another that at maximum a free space of half a diameter d/2 of a first longitudinal thread 3 is formed between them.

On account of the use of at least one first group and at least two second groups or of at least one second group and at least two first groups per repeat, according to the solution according to the invention, it is ensured that each first longitudinal thread is adequately supported by one second longitudinal thread. On account thereof, planarity of the first fabric layer is significantly increased in comparison with the fabric tapes known from the prior art. Since, furthermore, distinctly different dewatering behaviors are caused by way of the first and second groups and at least one first group and a plurality of second groups or at least one second group and a plurality of first groups are disposed in each repeat, a regular and thus easily visible hydraulic marking pattern of the fibrous web manufactured on such a fabric tape is effectively inhibited.

Here, a first and a second longitudinal thread are not to be considered as being offset in relation to one another if the straight line connecting the center point of the cross-sectional area of the first longitudinal thread and the center point of the cross-sectional area of the second longitudinal thread runs vertically to a plane defined by the first fabric layer.

Advantageous embodiments and refinements of the invention are stated in the dependent claims.

Advantageously, different numbers of first and second groups are provided in each repeat. Since the first and second groups have different dewatering behaviors and thus marking behaviors, it has been demonstrated that on account of this measure of different numbers of first and second groups in the repeat, an irregularity in the marking pattern can be generated, on account of which the markings are significantly less visible. This embodiment furthermore offers the possibility of influencing the dewatering behavior of the wire. In the event, for example, that more first groups than second groups are employed, a wire having a higher dewatering performance can be achieved than when more second groups than first groups are employed.

It is particularly conceivable in this context that the following applies:

$A=N\times B$; where

A=number of the first groups in the repeat

B=number of the second groups in the repeat

N=integer greater than 1 or $C=M\times D$; where

C=number of the second groups in the repeat

D=number of the first groups in the repeat

M is an integer greater than 1.

Specifically, the number of the first groups in the repeat may be 6 and the number of the second groups in the repeat may be 3, for example. Alternatively, the number of the second groups in the repeat may be 6 and the number of the first groups in the repeat may be 3, for example.

If an unequal number of first and second groups in the repeat is provided, it is particularly advantageous for the first and second groups in the repeat to be disposed in a plurality of superordinate groups of longitudinal threads, wherein each superordinate group of longitudinal threads comprises a first group and a second group and at least one further group selected from the first or second group, and wherein the repeat is formed by an integral number of superordinate groups of longitudinal threads which are disposed next to one another in the cross-thread direction. This means that only an integral number of superordinate groups of longitudinal threads are disposed in the repeat and no further other first and/or second group which is not a component part of one of the superordinate groups of longitudinal threads is present.

On account of the provision of a plurality of superordinate groups of longitudinal threads disposed next to one another in the repeat, a certain degree of regularity in the arrangement of the first and second groups is again achieved, on account of which a concentration of a plurality of identical groups being disposed immediately next to one another can be avoided.

In this context, a superordinate group of longitudinal threads may be formed by one first group and two second groups, for example. It is also conceivable for a superordinate group of longitudinal threads to be formed by two first groups and one second group.

Preferably, more second groups than first groups are provided in the repeat. Furthermore preferably, more second groups than first groups are provided in each superordinate group.

In order to achieve good fiber support of the dewatered fibrous web formed on the fabric tape according to the invention, it is preferably provided that the first fabric layer has an outer side which faces away from the second fabric layer and which, in the intended use of the fabric tape, provides a paper side which can be brought into contact with the fibrous material. It is furthermore preferably provided that the second fabric layer has an outer side which faces away from the first fabric layer and which, in the intended use of the fabric tape, provides a machine side which can be brought into contact with the machine.

In order to further avoid visible hydraulic markings as a result of a regular marking pattern it is furthermore advantageous for at maximum four of the same groups of the first or second group to be disposed directly next to one another.

Possibly, but not ultimately, the following configurations of the invention are conceivable with respect to the arrangement of first and second groups within each superordinate group (note: in the following, a first group is identified here using the symbol 1:1 and a second group using the symbol 2:1).

1) Each superordinate group comprises the following three first and second groups 2:1-2:1-1:1 and here has a ratio of the number of first longitudinal threads to the number of second longitudinal threads of 1.67.
2) Each superordinate group comprises the following five first and second groups 2:1-1:1-2:1-1:1-2:1 and here has a ratio of the number of first longitudinal threads to the number of second longitudinal threads of 1.6.
3) Each superordinate group comprises the following four first and second groups 2:1-2:1-2:1-1:1 and here has a ratio of the number of first longitudinal threads to the number of second longitudinal threads of 1.75.
4) Each superordinate group comprises the following five first and second groups 1:1-1:1-1:1-1:1-2:1 and here has a ratio of the number of first longitudinal threads to the number of second longitudinal threads of 1.2.
5) Each superordinate group comprises the following four first and second groups 1:1-1:1-1:1-2:1 and here has a ratio of the number of first longitudinal threads to the number of second longitudinal threads of 1.25.

6) Each superordinate group comprises the following three first and second groups 1:1-1:1-2:1 and here has a ratio of the number of first longitudinal threads to the number of second longitudinal threads of 1.33.

7) Each superordinate group comprises the following eight first and second groups 1:1-1:1-2:1-1:1-1:1-2:1-1:1-2:1 and here has a ratio of the number of first longitudinal threads to the number of second longitudinal threads of 1.375.

8) Each superordinate group comprises the following five first and second groups 1:1-2:1-1:1-2:1-1:1 and here has a ratio of the number of first longitudinal threads to the number of second longitudinal threads of 1.4.

In the case of all abovementioned examples 1-3, more second groups than first groups are present in each superordinate group. In the case of all aforementioned examples 4-8, fewer second groups than first groups are present in each superordinate group.

If more second than first groups are present, the focus of the wire construction is on a first fabric layer with a high number of fiber support points, wherein the fiber support points in the case of a plain weave are ascertained by multiplying the number of upper longitudinal threads by the effective number of upper cross threads, each pair of binder threads being classified in each case as an upper cross thread. On account of a high density of upper longitudinal threads, very thin upper cross threads may be used. The higher the ratio, the thinner the upper cross threads which may be used and the higher the number of fiber support points in a predefined number of upper cross threads. The number of pores is equal to the number of fiber support points.

If more first than second groups are present, the construction focus of the wire is on a high fiber support index (FSI), since here more upper cross threads can be incorporated in the comparatively more open arrangement of upper longitudinal threads on the paper side of the first fabric layer.

The fiber support index according to PCA awards double value to the number of upper cross threads as compared to the upper longitudinal threads. The shape of the openings (pores) formed on the paper side here is oriented in a cross-wise manner. The number of pores is equal to the number of fiber support points. These constructions are aimed at a very regular sheet formation, since the cross-wise oriented pores permit the paper fibers to penetrate the wire to a lesser extent and, on account thereof, very smooth fibrous-web surfaces can be achieved.

The longitudinal threads of the fabric tape preferably provide only first and second groups. On account thereof, it is achieved that each upper longitudinal thread is supported by a lower longitudinal thread.

In order to achieve further homogenization of the dewatering rates it is preferably provided that, when viewed in the direction along the cross threads, the first longitudinal threads are disposed offset in relation to the second longitudinal threads.

The first and the second fabric layer of the fabric tape according to the invention are preferably connected to one another by binder threads which are disposed in pairs.

In the case of the fabric tape according to the invention, the binder threads furthermore preferably extend in the direction of the cross threads. It should be noted at this stage that the longitudinal threads, in the intended use of the fabric tape in a paper-, cardboard- or tissue-making machine, extend in the conveying or machine direction of the fabric tape, and the cross threads extend in the machine cross direction.

The two binder threads of the respective pair of binder threads are preferably interwoven in a mutually interchanging manner with first and second longitudinal threads, wherein the binder threads of each pair, when changing from being interwoven with first longitudinal threads to being interwoven with second longitudinal threads and vice-versa, intersect while configuring intersection points.

The weaving path generated by interweaving the binder threads of one pair in a mutually interchanging manner with the first longitudinal threads preferably corresponds to a weaving path formed by interweaving a first cross thread with the first longitudinal threads. In this case, reference is made to "integral" binder threads, since the latter continue the weaving pattern formed by interweaving the first cross threads with the first longitudinal threads.

Each pair of binder threads in the repeat preferably provides merely two intersection points. The small number of intersection points per repeat contributes toward a very smooth and planar paper side of the first fabric layer.

It is furthermore provided that the binder threads of each pair, between immediately successive intersection points, form in each case first binder segments by interweaving with the first longitudinal threads, wherein at least one of the first binder segments of each pair of binder threads is formed in the repeat in that the respective binder thread, running on the outer side of the first fabric layer, intersects at least two, preferably at least three—such as, for example, four—not immediately successive first longitudinal threads. The long length of the first binder segments likewise contributes, as does the only small number of intersection points per repeat, toward a very smooth and planar paper side of the first fabric layer.

According to a further preferred embodiment of the invention, it is provided that the binder threads, when changing from being interwoven with the first longitudinal threads to being interwoven with the second longitudinal threads and vice-versa, running between the two fabric layers, intersect at maximum four immediately adjoining, preferably at maximum three immediately adjoining second longitudinal threads. On account of the comparatively short inner float length of the binder threads between the two fabric layers a good balance is achieved between small thickness of the fabric tape according to the invention, on the one hand, and decoupling of the supporting binder points and covering binder points of the binder threads when interconnecting the two fabric layers by way of the binder threads.

The binder threads of each pair of binder threads in the repeat together preferably form two first binder segments, wherein the one first binder segment is formed in that the one binder thread of the pair, when being interwoven with the first longitudinal threads, runs in an alternating manner on the outer side of the first fabric layer and between the first and second fabric layers and, running on the outer side of the first fabric layer, intersects at least two first longitudinal threads, and wherein the other first binder segment is formed in that the other binder thread of the pair, when being interwoven with the first longitudinal threads, runs in an alternating manner on the outer side of the first fabric layer and between the first and second fabric layers and, running on the outer side of the first fabric layer, intersects the same number of first longitudinal threads as the one binder thread, or up to four, in particular up to two fewer or more first longitudinal threads than the one binder thread. Also on account of the comparatively great length of the two first binder segments which, moreover, are of the same or almost the same length, the planarity of the first fabric layer is significantly increased, since, on account thereof, few intersection points of the mutually interchanging binder threads are created.

The first fabric layer is preferably formed by interweaving the first longitudinal threads with the first cross threads and the binder threads, wherein the second fabric layer is formed by interweaving the second longitudinal threads with the second cross threads. This means that the binder threads are an integral component part of the first fabric layer and do not at all contribute toward forming the second fabric layer but merely connect the latter to the first fabric layer.

According to a preferred embodiment of the invention, the weaving pattern of the first fabric layer forms a plain weave.

It is also conceivable for the weaving pattern of the second fabric layer to be repeated in second repeats, wherein each second repeat is formed by N second longitudinal threads and 2×N second cross threads, wherein N is an integer greater than zero.

It is particularly conceivable for the weaving pattern of the first fabric layer to form a plain weave and for the weaving pattern of the second fabric layer to be a regular or irregular satin weave, in particular a satin weave having N=5, or 6, or 8 second longitudinal threads and, according to the formula, 2×N=10, or 12, or 16 second cross threads.

Alternatively thereto, it is conceivable for the weaving pattern of the first fabric layer to form a plain weave and for the weaving pattern of the second fabric layer to be a twill weave or a broken twill weave.

The ratio of first warp threads to second warp threads is preferably greater than 1.5 and in particular smaller than 2. On account thereof, it is possible, for example, to provide both high fiber support with FSI values in the range from 260 to 300, in conjunction with high resistance to abrasion and/or dimensional stability of the fabric tape according to the invention. In this context, it is particularly conceivable for the ratio of first warp threads to second warp threads to be 5:3.

The diameter of the second longitudinal threads preferably lies in the range from 0.15 mm to 0.45 mm, wherein in particular the first longitudinal threads have a diameter of 30% to 60%, preferably 38% to 53%, of the diameter of the second longitudinal threads. On account thereof, a fabric tape having a particularly fine first fabric layer, the second fabric layer of which, however, is sufficiently stable in order to provide a high wear volume and/or high dimensional stability, can be created.

In order to achieve a particularly fine paper side which offers high fiber support, it is in particular conceivable for the first longitudinal threads to have a diameter of 0.1 mm or smaller.

In order to provide high fiber support, it is in particular furthermore provided that the ratio of the number of first cross threads and pairs of binder threads to the number of second cross threads is greater than or equal to 2, in particular is 2:1, or 3:2, or 5:3.

According to a further particularly preferred embodiment of the invention, it is in particular conceivable for the first cross threads, the binder threads which are disposed in pairs, and the second cross threads to be disposed in first, second, third, and fourth cross-thread groups, wherein a first cross-thread group is formed by one first and one second cross thread and one pair of binder threads, a second cross-thread group is formed by two first cross threads and two second cross threads and one pair of binder threads, a third cross-thread group is formed by one first cross thread and two second cross threads and one pair of binder threads, and a fourth cross-thread group is formed by two first cross threads and one second cross thread and one pair of binder threads.

The aforementioned refinement may also represent an invention which is independent of the present invention and may be the subject matter of a separate patent application.

In this context, it is particularly conceivable for the cross threads and binder threads in the repeat to be disposed in a plurality of superordinate groups of cross threads, wherein one superordinate group of cross threads is formed by at least two cross-thread groups selected from the first, second, third or fourth cross-thread group, and wherein the repeat is formed by an integral number of superordinate groups of cross threads which are disposed next to one another in the longitudinal-thread direction. This means that only an integral number of the superordinate group of cross threads are disposed in the repeat and no further other first and/or second cross-thread group which is not a component part of one of the superordinate groups of cross threads is present.

Here, under each first cross thread, one second cross thread is preferably disposed in such a manner that each first cross thread is supported by a second cross thread. On account thereof, cross-wise stability of the fabric tape according to the invention is significantly increased.

When viewed in the direction along the longitudinal threads, at least some of the first and the second cross threads are preferably disposed so as to be offset in relation to one another. Here, a first and a second cross thread are not to be considered as being offset in relation to one another if the straight line connecting the center point of the cross-sectional area of the first cross thread and the center point of the cross-sectional area of the second cross thread runs vertically to a plane defined by the first fabric layer.

In order to obtain as regular a first fabric layer as possible, it is particularly meaningful for the first cross threads and/or the binder threads to have a diameter of 80% to 120% of the diameter of the first longitudinal threads.

In the case of the fabric tape according to the invention being a so-called "weft runner", that is to say a fabric tape in which the machine side is substantially provided by the abrasion volume of the second cross threads, it is particularly meaningful for the second cross threads to have a diameter of 100% to 200% of the diameter of the second longitudinal threads.

In the event that the threads do not have a circular cross-sectional area, the term diameter is intended to mean the diameter of a circular cross-sectional area which has the same surface area as the cross-sectional area which does not have a circular cross section.

The first fabric layer of the fabric tape according to the invention, according to a further preferred embodiment of the invention, preferably has a fiber support index (FSI) of 260 to 300, calculated according to the publication "Approved Standard Measuring Method" of the Papermachine Clothing Association (PCA), 19 Rue de la République, 45000 Orléans, France, dated June 2004. On account thereof, it is possible to ensure very good fiber support and retention.

In order to achieve, on the other hand, a high dewatering performance, it is furthermore meaningful for high permeability to be provided despite the abovementioned high FSI value. According to a further particularly preferred embodiment of the invention, it is thus provided that the fabric tape has a permeability in the range of 250 cfm to 450 cfm, preferably 300 cfm to 400 cfm, measured at a differential pressure of 100 to 127 Pa, as laid down in the publication "Approved Standard Measuring Method" of the Papermachine Clothing Association (PCA), 19 Rue de la République, 45000 Orléans, France, dated June 2004.

Other features which are considered as characteristic for the invention are set forth in the appended claims.

Although the invention is illustrated and described herein as embodied in a forming wire, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
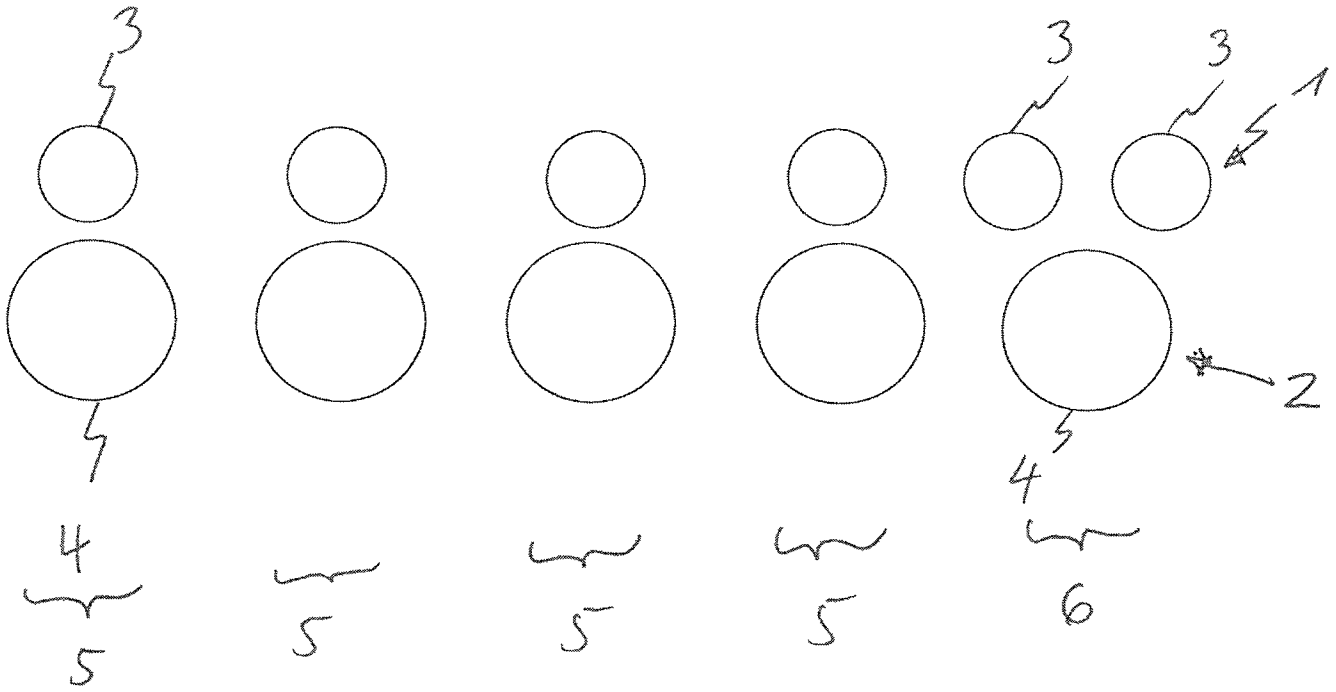
FIGS. 1A, 1B, 1C, 1D, and 1E are highly diagrammatic view of various designs of the construction and the arrangement of the two layers of longitudinal threads, according to the invention.

Referring now to the figures of the drawing in detail and first, particularly, to FIGS. 1A to 1E thereof, there are shown a plurality of designs of the construction and the arrangement of longitudinal threads 3, 4 in a first and second fabric layer 1, 2 of a fabric tape according to the invention. The illustration of FIGS. 1A-1E shows the relative arrangement of the longitudinal threads 3, 4 of a first and second fabric layer 1, 2, in a sectional plane which is perpendicular to the first and second longitudinal threads 3, 4. For the sake of clarity, an illustration of the cross threads and (any potential) binder threads of the fabric tape according to the invention has been dispensed with in FIGS. 1A-1E. It should furthermore be noted that the arrangements of first and second groups, shown in FIGS. 1A-1E, may be repeated several times in the repeat of a fabric tape according to the invention, that is to say that the arrangement shown in the respective figure in each case represents one superordinate group of longitudinal threads which is repeated several times in the repeat, wherein the repeat is formed only by an integral number of the shown superordinate groups of longitudinal threads which are disposed next to one another in the cross-thread direction.

As can be identified in FIG. 1A, the two fabric layers 1, 2 are disposed on top of one another, and the first longitudinal threads 3 and the second longitudinal threads 4 are disposed in a plurality of groups 5, 6. In the present case, four first groups 5 and one second group 6 are formed here, that is to say that one superordinate group of longitudinal threads is formed by four first groups 5 and one second group 6. The first groups 5 are all disposed in an immediately adjoining manner to one another, followed by the one second group 6. Each of the first groups 5, in the present case, is constructed from one first longitudinal thread 3 and, disposed therebelow, one second longitudinal thread 4, wherein, in the present case, the first and second longitudinal threads 3, 4, when viewed in a projection which is perpendicular onto the fabric layers, are disposed so as not to be offset in relation to one another. The second group 6 is furthermore constructed from two first longitudinal threads 3 and, disposed therebelow, one second longitudinal thread 4, wherein, in the present case, the two first longitudinal threads, when viewed in a projection which is perpendicular onto the fabric layers 1, 2, are disposed so as to be only slightly offset in relation to one another, such that said two first longitudinal threads mutually overlap. In the present case, the ratio of first longitudinal threads to second longitudinal threads is 6:5=1.2.

Figure 1B:
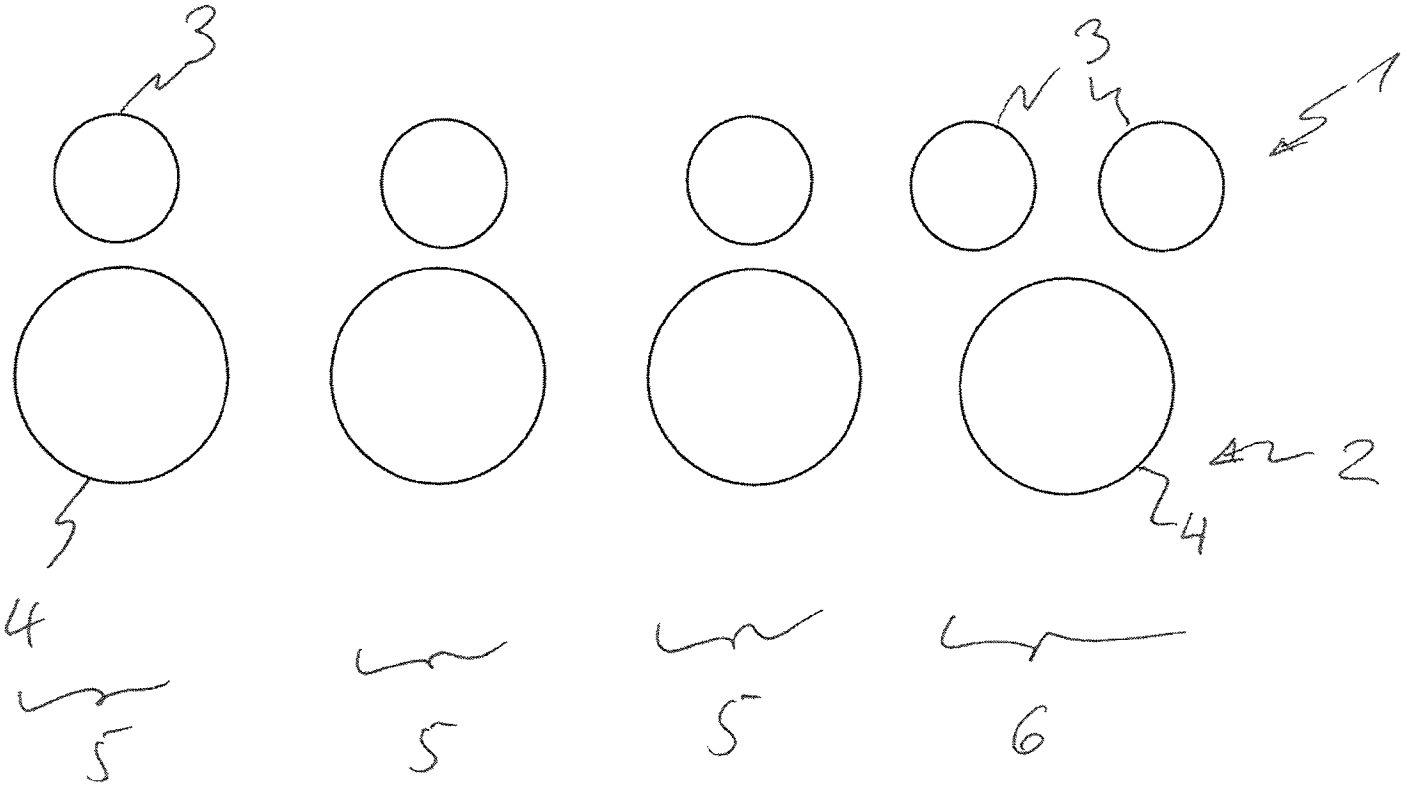

The embodiment illustrated in FIG. 1B differs from the embodiment shown in FIG. 1A merely in that the fabric tape comprises only three first groups instead of four first groups, that is to say that one superordinate group of longitudinal threads is formed by three first groups 5 and one second group 6. Therefore, the ratio of first longitudinal threads to second longitudinal threads is 5:4=1.25. Except for this, all other implementations realized in FIG. 1A also apply to the embodiment of FIG. 1B.

Figure 1C:
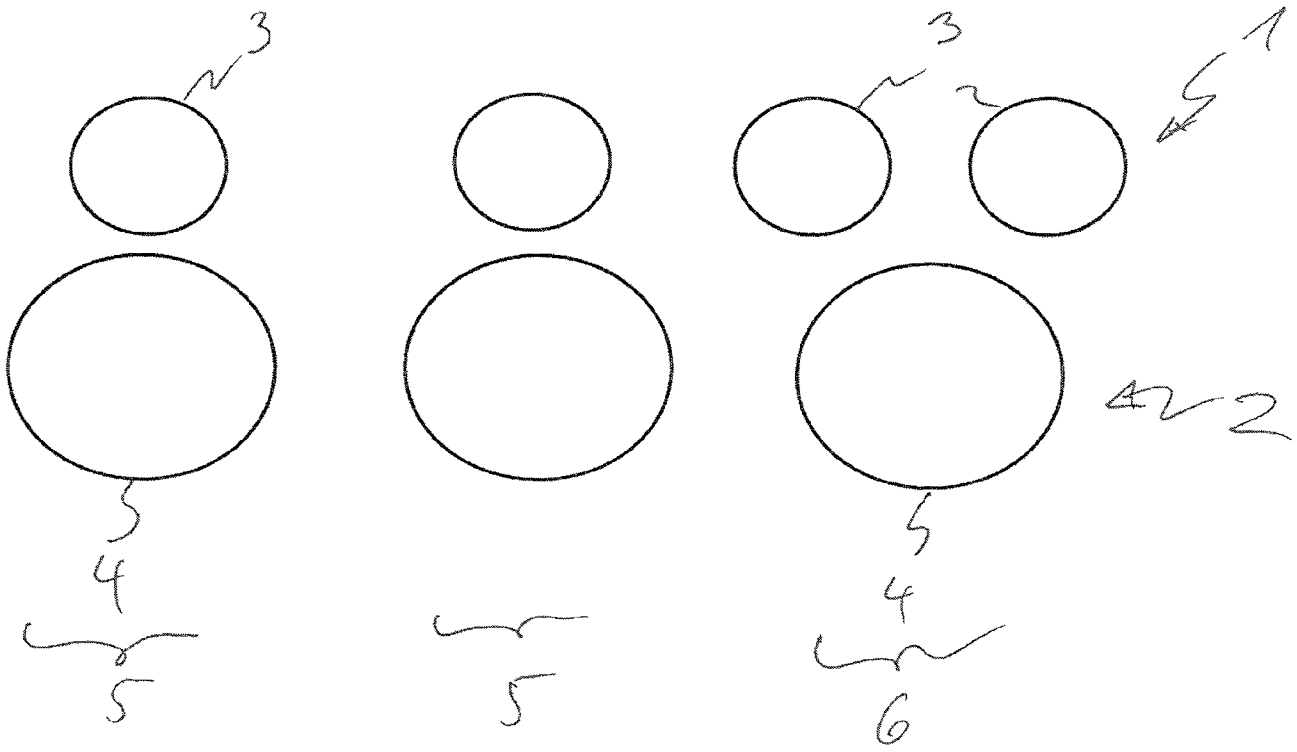

The embodiment illustrated in FIG. 1C differs from the embodiment shown in FIG. 1A only in that the fabric tape comprises only two first groups instead of four first groups, that is to say one superordinate group of longitudinal threads is formed by two first groups 5 and one second group 6. Therefore, the ratio of first longitudinal threads to second longitudinal threads is 4:3=1.333. Except for this, all other implementations realized in FIG. 1A also apply to the embodiment of FIG. 1C.

Figure 1D:
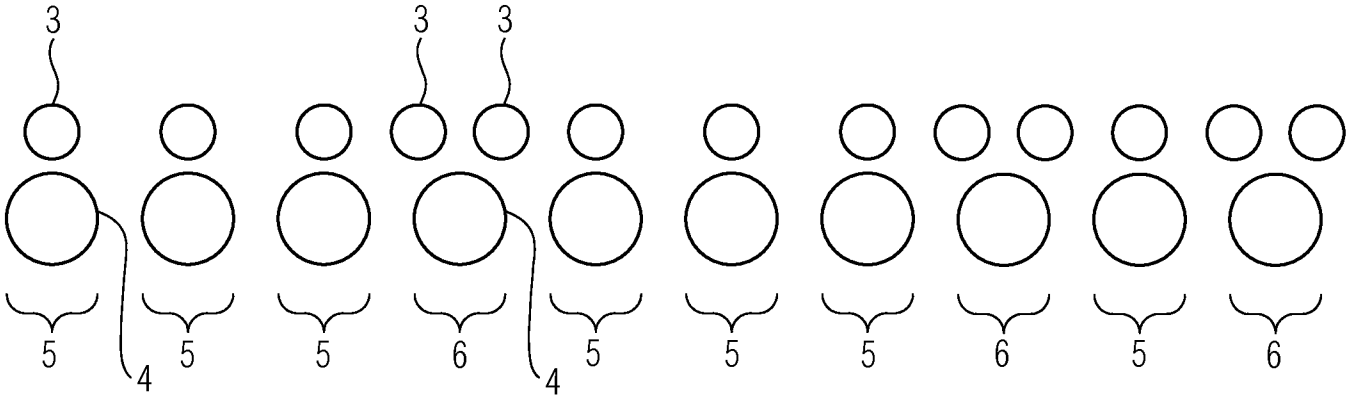

As can be identified in FIG. 1D, the two fabric layers 1, 2 are disposed on top of one another, and the first longitudinal threads 3 and the second longitudinal threads 4 are disposed in a plurality of groups 5, 6. In the present case, seven first groups 5 and three second groups 6 are formed here, that is to say that one superordinate group of longitudinal threads is formed by seven first groups 5 and three second groups 6. The arrangement of the first and second groups 5, 6 in relation to one another here is such that an arrangement which is formed from three immediately adjoining first groups 5 is provided, followed by one united second group 6, and in turn followed by an arrangement from three immediately adjoining first groups 5, and on which, following therefrom, in turn one second group 6, one first group 5 and again one second group 6 are disposed in an alternating manner. In the present case, each of the first groups 5 is constructed from one first longitudinal thread 3 and, disposed therebelow, one second longitudinal thread 4, wherein, in the present case, the first and second longitudinal threads 3, 4, when viewed in a projection which is perpendicular onto the fabric layers, are disposed so as not to be offset in relation to one another. The second group 6 is furthermore constructed from two first longitudinal threads 3 and, disposed therebelow, one second longitudinal thread 4, wherein, in the present case, the two first longitudinal threads, when viewed in a projection which is perpendicular onto the fabric layers 1, 2, are disposed so as to be only slightly offset in relation to one another, such that said two first longitudinal threads mutually overlap. In the present case, the ratio of first longitudinal threads to second longitudinal threads is 13:10=1.3.

Figure 1E:
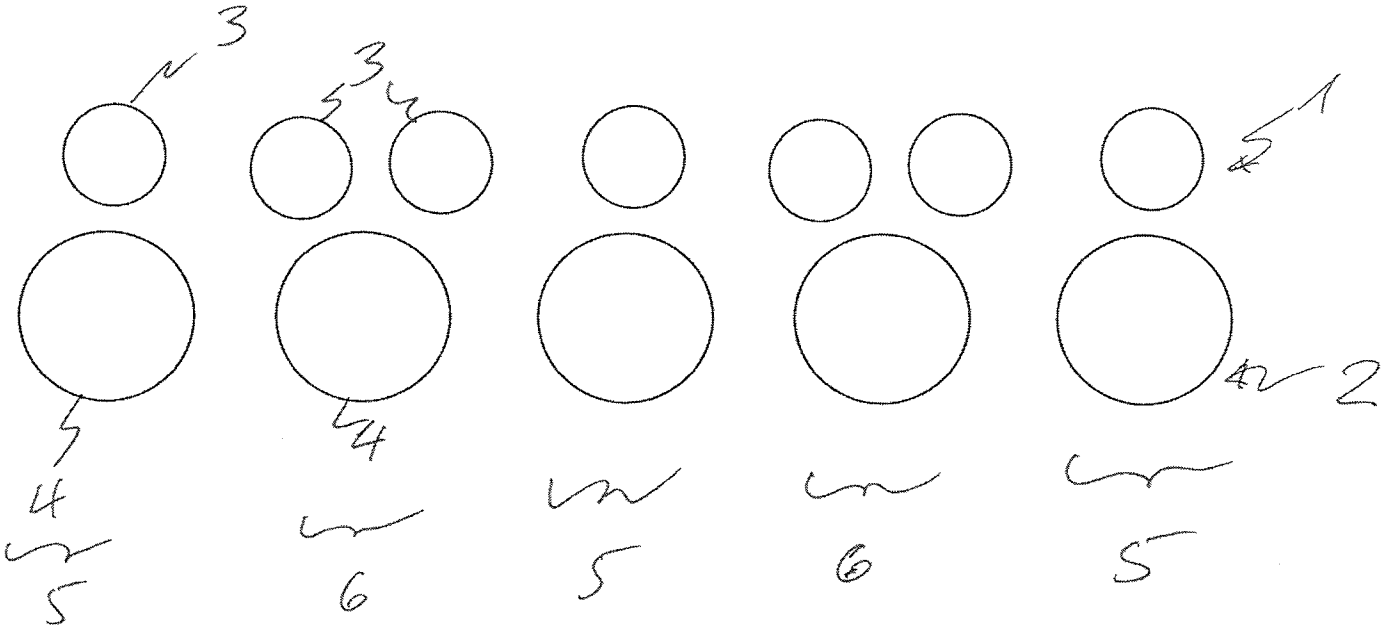

As can be identified in FIG. 1E, the two fabric layers 1, 2 are disposed on top of one another, and the first longitudinal threads 3 and the second longitudinal threads 4 are disposed in a plurality of groups 5, 6. In the present case, three first groups 5 and two second groups 6 are formed here, that is to say that one superordinate group of longitudinal threads is formed by three first groups 5 and two second groups 6. Immediately successive first groups 5 are in each case separated from one another by one second group 6. In the present case, each of the first groups 5 is constructed from one first longitudinal thread 3 and, disposed therebelow, one second longitudinal thread 4, wherein, in the present case, the first and second longitudinal threads 3, 4, when viewed in a projection which is perpendicular onto the fabric layers, are disposed so as not to be offset in relation to one another. The second group 6 is furthermore constructed from two first longitudinal threads 3 and, disposed therebelow, one second longitudinal thread 4, wherein, in the present case, the two first longitudinal threads, when viewed in a projection which is perpendicular onto the fabric layers 1, 2, are disposed so as to be only slightly offset in relation to one another, such that said two first longitudinal threads mutually overlap. In the present case, the ratio of first longitudinal threads to second longitudinal threads is 7:5=1.4.

Figure 2:
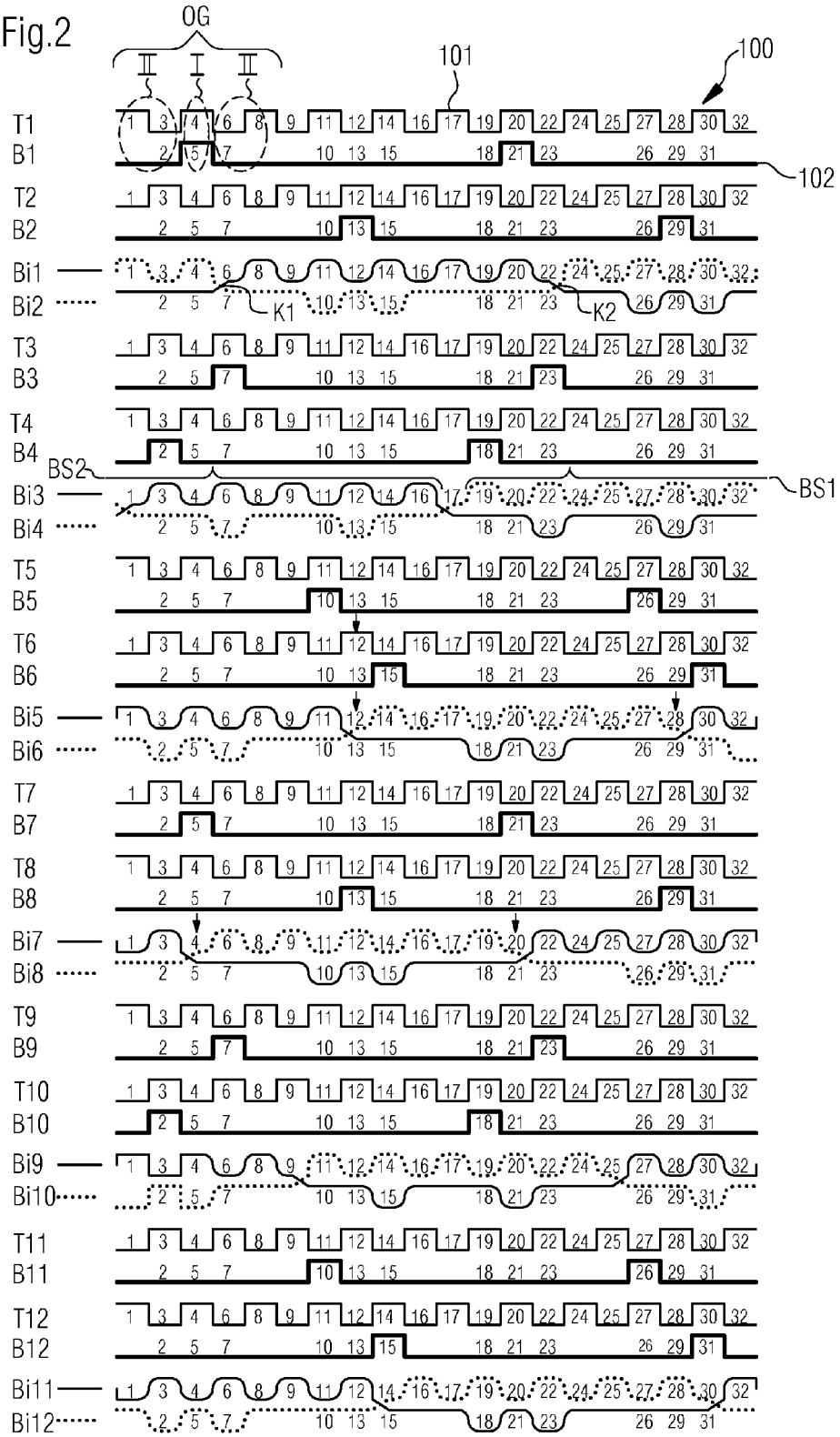
FIG. 2 shows a repeat of a further embodiment of a fabric tape according to the invention, in the direction of the cross threads.

FIG. 2 shows a repeat of a further embodiment of a fabric tape 100 according to the invention, in the direction of the cross threads.

Figure 3:
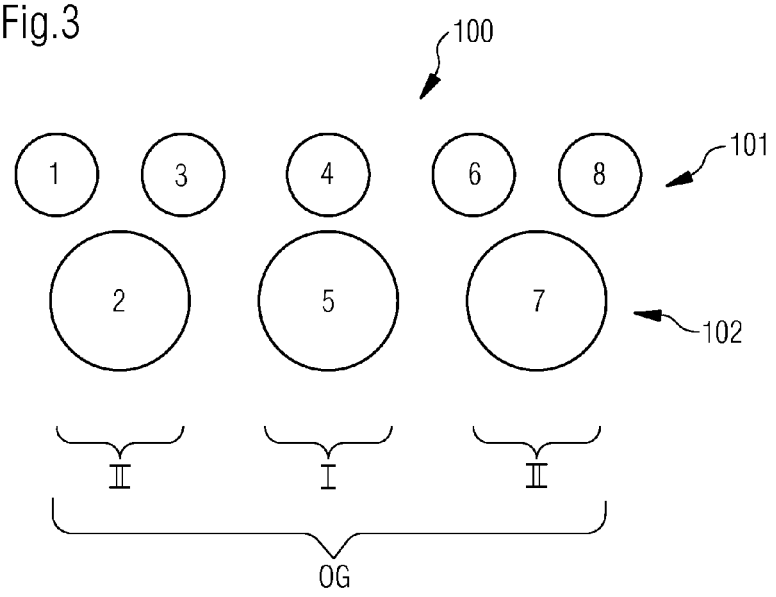
FIG. 3 shows the arrangement of the two layers of longitudinal threads of the fabric tape shown in FIG. 2.
Figure 4:
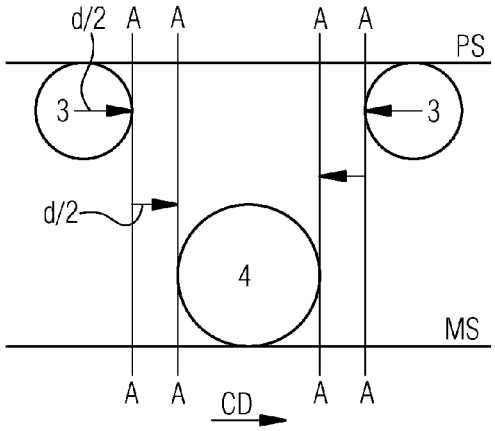
FIG. 4 shows the arrangement of a second group of longitudinal threads.
Figure 5:
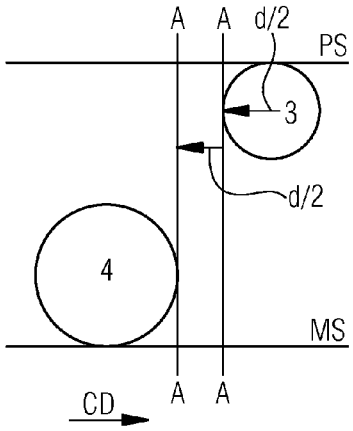
FIG. 5 shows the arrangement of a first group of longitudinal threads.

It should be pointed out that the illustration of FIG. 2 is a merely schematic one and in particular depicts the arrangement of the first and second longitudinal threads in relation to one another, according to the invention, only in an incomplete manner. The correct arrangement of the first and second longitudinal threads is depicted in FIG. 3, however, without the cross threads and binder threads being shown there.

The fabric tape 100 has a first fabric layer 101 and a second fabric layer 102. The outer side of the first fabric layer 101, which faces away from the second fabric layer 102, here provides a paper side, and the outer side of the second fabric layer 102, which faces away from the first fabric layer 101, provides a machine side.

The first fabric layer 101 is formed by interweaving first longitudinal threads 1, 3, 4, 6, 8, 11, 12, 14, 16, 17, 19, 20, 22, 24, 25, 27, 28, 30, and 32 with the first cross threads T1-T12 and with the binder threads Bi1-Bi12, which are disposed in pairs, wherein the weaving pattern of the first fabric layer is a plain weave.

The second fabric layer 102 is formed by interweaving second longitudinal threads 2, 5, 7, 10, 13, 15, 18, 21, 23, 26, 29, and 31 with second cross threads B1-B12, wherein the weaving pattern of the second fabric layer is a satin weave which is repeated in second repeats which are formed from six second longitudinal threads and six second cross threads.

The ratio of the first longitudinal threads to the second longitudinal threads in the present case is 5:3. Furthermore, the ratio of first cross threads and pairs of binder threads—here, each pair of binder threads counts as one first cross thread—to the second cross threads is 3:2.

As can be obtained from the illustration of FIG. 2, two first cross threads T1-T12 and two second cross threads B1-B12 are in each case disposed between two immediately successive pairs of binder threads Bi1/Bi2; Bi3/Bi4; Bi5/Bi6; Bi7/Bi8; Bi9/Bi10; Bi11/B12.

The binder threads which are disposed in pairs of each pair are interwoven in a mutually interchanging manner with the first and the second longitudinal threads and here intersect when changing from being interwoven with first longitudinal threads to being interwoven with second longitudinal threads and vice-versa, while configuring intersection points K1, K2. In the present case, each pair of binder threads Bi1/Bi2; Bi3/Bi4; Bi5/Bi6; Bi7/Bi8; Bi9/Bi10; Bi11/Bi12 in the repeat provides two intersection points K1, K2, wherein the binder threads, when changing from being interwoven with the first longitudinal threads to being interwoven with the second longitudinal threads and vice-versa, running between the two fabric layers 101, 102 intersect at maximum three immediately adjoining second longitudinal threads.

Furthermore, in the present case the binder threads of each pair of binder threads in the repeat together form in each case two first binder segments BS1, BS2, wherein the one first binder segment BS1 is formed in that the one binder thread of the pair, when being interwoven with the first longitudinal threads, runs in an alternating manner on the outer side of the first fabric layer 101 and between the first and second fabric layers 101, 102 and, running on the outer side of the first fabric layer 101, intersects at least five first longitudinal threads, and wherein the other first binder segment BS2 is formed in that the other binder thread of the pair, when being interwoven with the first longitudinal threads, runs in an alternating manner on the outer side of the first fabric layer and between the first and second fabric layers and, running on the outer side of the first fabric layer, intersects the same number of first longitudinal threads as the one binder thread.

FIG. 3 shows the relative arrangement of the first and second longitudinal threads of the fabric tape to one another, illustrated in FIG. 2, using the example of the first longitudinal threads 1, 3, 4, 6 and 8 and the second longitudinal threads 2, 5, and 7. The arrangement shown here of first groups I and second groups II represents a superordinate group OG of longitudinal threads which is repeated four times in the repeat, such that the repeat of the fabric tape has the following arrangement of first and second groups:

second group-first group-second group-second group-first group-second group-second group-first group-second group-second group-first group-second group.

In other words, the repeat is formed by four superordinate groups OG of longitudinal threads which are disposed next to one another in the cross-thread direction.

This means that in the present exemplary embodiment the longitudinal threads of the fabric tape 100 form only first and second groups, wherein, in the present case, eight second groups II and four first groups I are present in the repeat.

One identifies that the first longitudinal threads 1, 3 form a second group II with the second longitudinal thread 2. One furthermore identifies that the first longitudinal threads 6, 8 form a further second group II with the second longitudinal thread 7. One first group, which is formed by the first longitudinal thread 4 and the second longitudinal thread 5, is disposed between the two aforementioned second groups. What has been stated above correspondingly applies to first and second groups I, II, which are formed by the further first and second longitudinal threads.

The invention claimed is:

1. A fabric tape for a machine for manufacturing and/or processing a fibrous web, the fabric tape comprising:

a first fabric layer having first longitudinal threads and first cross threads interwoven with said first longitudinal threads;

a second fabric layer having second longitudinal threads and second cross threads interwoven with said second longitudinal threads;

said first and second fabric layers being disposed on top of one another and having a weaving pattern repeated in repeats;

said first longitudinal threads and said second longitudinal threads in each repeat being disposed in a plurality of groups, having one first group and one second group and at least one further of said first and/or second group;

each said first group being formed by one first longitudinal thread and one second longitudinal thread disposed below said one first longitudinal thread;

each said second group being formed by two first longitudinal threads and one second longitudinal thread disposed below said two first longitudinal threads;

said first and second longitudinal threads in each group, viewed in a projection perpendicularly onto said fabric layers, being disposed so as not to be offset or only slightly offset in relation to one another, with a maximum offset defining a free space of half a diameter of a first longitudinal thread therebetween; and wherein a number of first groups of longitudinal threads is different from a number of second groups of longitudinal threads.

2. The fabric tape according to claim 1, wherein:

said first and second groups in the repeat are disposed in a plurality of superordinate groups of longitudinal threads;

each superordinate group of longitudinal threads comprises a first group, a second group, and at least one further group being a first or second group;

the repeat is formed by an integral number of superordinate groups of longitudinal threads disposed next to one another in a cross-thread direction.

3. The fabric tape according to claim 1, wherein the same of the first or second group of longitudinal threads is disposed directly next to one another at maximum four times.

4. The fabric tape according to claim 1, configured as a forming wire for processing fibrous material, with said first fabric layer having an outer side facing away from said second fabric layer and which, on use of the forming wire, provides a paper side to be brought into contact with the fibrous material.

5. The fabric tape according to claim 1, configured as a forming wire, with said second fabric layer having an outer side facing away from said first fabric layer and which, on use of the fabric tape, provides a machine side to be brought into contact with the machine.

6. The fabric tape according to claim 1, wherein the fabric tape has only said first and second groups of longitudinal threads.

7. The fabric tape according to claim 1, which comprises binder threads disposed in pairs and connecting said first and second fabric layers to one another.

8. The fabric tape according to claim 7, wherein said binder threads extend in a cross-thread direction.

9. The fabric tape according to claim 7, wherein each pair of binder threads has two binder threads respectively interwoven in a mutually interchanging manner with first and second longitudinal threads and intersecting at intersection points upon changing from being interwoven with the first longitudinal threads to being interwoven with the second longitudinal threads and vice-versa.

10. The fabric tape according to claim 9, wherein each respective pair of binder threads in the repeat provides for two intersection points.

11. The fabric tape according to claim 7, wherein said binder threads of each pair of binder threads, between immediately successive intersection points, form in each case first binder segments by interweaving with said first longitudinal threads, and at least one of said first binder segments of each pair of binder threads is formed in the repeat in that the respective said binder thread, running on an outer side of said first fabric layer, intersects at least four, not immediately successive first longitudinal threads.

12. The fabric tape according to claim 11, wherein said binder threads of each pair of binder threads in the repeat together form two first binder segments, wherein the one first binder segment is formed in that the one binder thread of the pair, when being interwoven with the first longitudinal threads, runs alternatingly on the outer side of the first fabric layer and between the first and second fabric layers and, running on the outer side of the first fabric layer, intersects at least two first longitudinal threads, and wherein the other first binder segment is formed in that the other binder thread of the pair, when being interwoven with the first longitudinal threads, runs alternatingly on the outer side of the first fabric layer and between the first and second fabric layers and, running on the outer side of the first fabric layer, intersects the same number of first longitudinal threads as the one binder thread.

13. The fabric tape according to claim 11, wherein said binder threads of each pair of binder threads in the repeat together form two first binder segments, wherein the one first binder segment is formed in that the one binder thread of the pair, when being interwoven with the first longitudinal threads, runs alternatingly on the outer side of the first fabric layer and between the first and second fabric layers and, running on the outer side of the first fabric layer, intersects at least two first longitudinal threads, and wherein the other first binder segment is formed in that the other binder thread of the pair, when being interwoven with the first longitudinal threads, runs alternatingly on the outer side of the first fabric layer and between the first and second fabric layers and, running on the outer side of the first fabric layer, intersects a number of first longitudinal threads that is greater or smaller by up to four first longitudinal threads than the one binder thread.

14. The fabric tape according to claim 13, wherein the other binder thread intersects up to two fewer or more first longitudinal threads than the one binder thread.

15. The fabric tape according to claim 7, wherein said first fabric layer is formed by interweaving said first longitudinal threads with said first cross threads and said binder threads, and said second fabric layer is formed by interweaving said second longitudinal threads with said second cross threads.

16. The fabric tape according to claim 1, wherein a ratio of first warp threads to second warp threads is greater than 1.5.

17. The fabric tape according to claim 16, wherein the ratio of the first warp threads to the second warp threads is smaller than 2.

18. The fabric tape according to claim 1, wherein said first fabric layer forms a plain weave.

19. The fabric tape according to claim 1, wherein said first and second fabric layers are configured as a forming wire for a papermaking machine.

20. A fabric tape for a machine for manufacturing and/or processing a fibrous web, the fabric tape comprising:

a first fabric layer having first longitudinal threads and first cross threads interwoven with said first longitudinal threads;

a second fabric layer having second longitudinal threads and second cross threads interwoven with said second longitudinal threads;

said first and second fabric layers being disposed on top of one another and having a weaving pattern repeated in repeats;

binder threads disposed in pairs and connecting said first and second fabric layers to one another;

said first longitudinal threads and said second longitudinal threads in each repeat being disposed in a plurality of groups, having one first group and one second group and at least one further of said first and/or second group;

each said first group being formed by one first longitudinal thread and one second longitudinal thread disposed below said one first longitudinal thread;

each said second group being formed by two first longitudinal threads and one second longitudinal thread disposed below said two first longitudinal threads;

said first and second longitudinal threads in each group, viewed in a projection perpendicularly onto said fabric layers, being disposed so as not to be offset or only slightly offset in relation to one another, with a maximum offset defining a free space of no more than one half a diameter of a first longitudinal thread;

said binder threads of each pair of binder threads, between immediately successive intersection points, forming in each case first binder segments by interweaving with said first longitudinal threads, and at least one of said first binder segments of each pair of binder threads being formed in the repeat in that the respective said binder thread, running on an outer side of said first fabric layer, intersects at least four, not immediately successive first longitudinal threads.

* * * * *